US008001908B2

(12) United States Patent
Webster et al.

(10) Patent No.: US 8,001,908 B2
(45) Date of Patent: Aug. 23, 2011

(54) MODEL VEHICLE WITH AUTOMATED DOOR MECHANISM

(75) Inventors: Richard F. Webster, Carson, CA (US); Steven R. Greening, Grosse Pointe Woods, MI (US)

(73) Assignee: Lionel L.L.C., Chesterfield, MI (US)

( * ) Notice: Subject to any disclaimer, the term of this patent is extended or adjusted under 35 U.S.C. 154(b) by 1405 days.

(21) Appl. No.: 11/139,177

(22) Filed: May 27, 2005

(65) Prior Publication Data

US 2006/0054051 A1 Mar. 16, 2006

Related U.S. Application Data

(60) Provisional application No. 60/575,265, filed on May 28, 2004.

(51) Int. Cl.
*B61D 3/00* (2006.01)

(52) U.S. Cl. ..... 105/282.1; 105/280; 105/339

(58) Field of Classification Search ..... 105/282.1, 105/280, 282.2, 282.3, 339, 343, 332, 333, 105/341, 378

See application file for complete search history.

(56) References Cited

U.S. PATENT DOCUMENTS

| | | | | |
|---|---|---|---|---|
| 2,317,363 | A * | 4/1943 | Dahl | 105/341 |
| 5,483,769 | A * | 1/1996 | Zweili | 49/118 |
| 6,457,681 | B1 * | 10/2002 | Wolf et al. | 246/187 A |
| 2003/0046872 | A1 * | 3/2003 | Fukumura et al. | 49/360 |
| 2003/0192255 | A1 * | 10/2003 | Rogers et al. | 49/360 |

FOREIGN PATENT DOCUMENTS

DE 34 01 390 * 7/1985

* cited by examiner

*Primary Examiner* — Mark T Le
(74) *Attorney, Agent, or Firm* — O'Melveny & Myers LLP

(57) ABSTRACT

A model vehicle, such as a model electric train, includes a model automatic door. The operation of the door is automated using a motor, drive train, and control circuit. A drive mechanism moves the door between open and closed positions. In the open position, the door is displaced laterally along and displaced outwardly of the body of the train car to expose a door opening. In the closed position, the door is substantially flush with the body of the car and covers the door opening. The control circuit permits automatic operation of the door and provides various features for enhancing realism of the operating model.

1 Claim, 8 Drawing Sheets

MODEL VEHICLE WITH AUTOMATED DOOR MECHANISM

CROSS-REFERENCE TO RELATED APPLICATION

This application claims priority pursuant to 35 U.S.C. §119 (e) to U.S. Provisional Application No. 60/575,265, filed May 28, 2004, which application is specifically incorporated herein, in its entirety, by reference.

BACKGROUND OF THE INVENTION

1. Field of the Invention

The present invention relates to electric-powered model vehicles, such as model trains, and more particularly, to an automatic door mechanism for a model train or other model vehicle.

2. Description of Related Art

Various model trains and vehicles are known in the art, which model an actual or imaginary train or vehicle at a reduced scale. In a typical model layout, a model train having an engine is provided. The model train engine includes an electrical motor that receives power from a voltage that is applied to model railway tracks. A transformer is used to apply the power to the tracks, while contacts (e.g., a roller) on the bottom of the train, or metallic wheels of the train, pick up the applied power for the train motor. In some model train layouts, the transformer controls the amplitude, and in a DC system, the polarity, of the voltage, thereby controlling the speed and direction of the train. In HO systems, the voltage is a DC voltage. In O-gauge systems, the track voltage is an AC voltage transformed by the transformer from a household line voltage provided by a standard wall socket, such 120 or 240 V, to a reduced AC voltage, such as 0-18 volts AC.

Some model train cars include functional doors, which can be opened and closed either manually, or by operation of a motor. Notwithstanding their advantages, however, functional doors for model vehicles may be subject to certain disadvantages. For example, some conventional trains have doors that are manually operated. To open and close such manual doors, the user must handle the model train car, disrupting the consistency of a reduced-scale layout. Some model train cars may comprise doors that are motor driven. For some train cars, motorized doors are arranged to slide back and forth on door guides. While this arrangement may be sufficient for model freight train cars, it does not achieve an acceptable degree of realism for passenger train cars where the door or doors are flush with the body of the train car when in a closed position, and thus, cannot only slide back and forth. Further, prior-art train cars having motorized doors are configured to open and close the doors using a fixed cycle, instead of remaining open until commanded to shut. Additionally, prior-art train cars do not provide for motor driven door mechanisms having two or more doors that open and close synchronously, thereby resulting in a less than desirable level of realism.

Accordingly, a need exists for a model train with a motorized door mechanism that overcomes these and other limitations of the prior art.

SUMMARY OF THE INVENTION

The invention provides a model vehicle with an automatically operated motorized door. A model vehicle in accordance with the present invention comprises an exterior body having a door configured for movement between an open position and a closed position. The model toy vehicle further comprises a controller configured to generate a control signal for causing the door to move between open and closed positions, and a motor responsive to the control signal. A model vehicle in accordance with the present invention may further include a cam or other suitable motion-transformation mechanism and a gear set intermediate an output shaft of the motor. The motion-transformation mechanism may be operable to transfer the output shaft rotation to a linear motion of the model vehicle doors along at least two transverse axes of motion.

In an embodiment of the invention, the motion-transformation mechanism comprises a cam operable to move one or more doors inward and outward, relative to an exterior panel of the motor vehicle body, along a first axis of motion. The door mechanism is further operable to slide the doors apart and together, along a second axis of motion substantially parallel to the exterior panel of the motor vehicle, transverse to the first axis of motion. According to this embodiment, therefore, the door mechanism moves the door between open and closed positions in response to the control signal, such that the door overlaps a panel of the body when in an open position and is flush with the body when in a closed position.

A more complete understanding of the model vehicle with automated door mechanism will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a model vehicle with automated model pantograph, that overcomes the limitations of the prior art. In the detailed description that follows, like element numerals are used to indicate like elements appearing in one or more of the figures.

Figure 1:
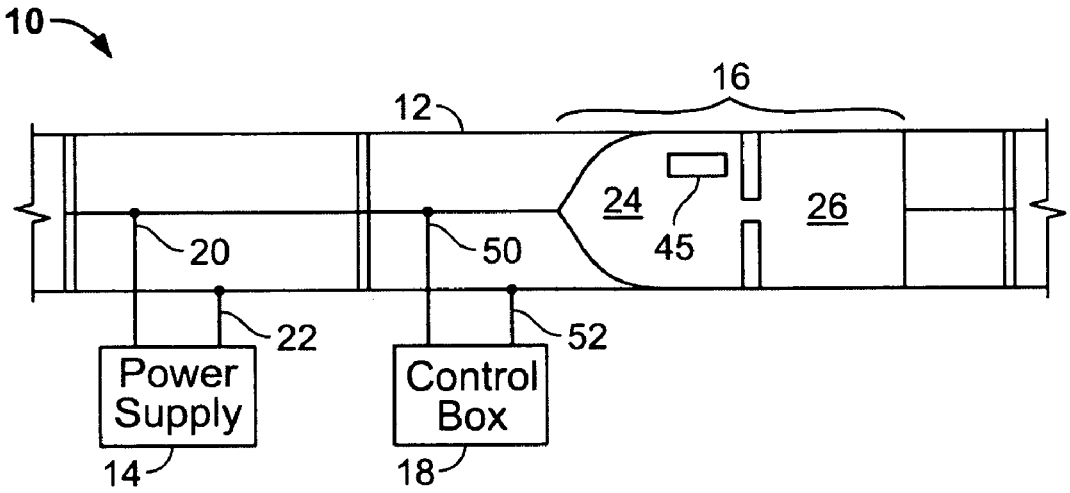
FIG. 1 is a plan view of a model vehicle layout in accordance with the present invention.

FIG. 1 shows a first exemplary embodiment of a model vehicle system 10. Model vehicle system 10 includes a track 12, a power supply 14, a train 16 and a control box 18. In an exemplary embodiment, track 12 may comprise a three rail track that is configured for travel thereon by train 16. Power source 14 provides power to track 12 by way of connectors 20 and 22, wherein the power terminal of the power supply is connected to the center or third rail of track 12, and the neutral terminal is connected to at least one of the two outer rails of track 12. Locomotive 24 of train 16 may be configured with contacts on the bottom thereof, or an arrangement of electrically conductive metallic wheels, to pick up the applied power and supply it to the electric motor of locomotive 24. In the alternative, or in addition, train cars other than locomotive 24 (i.e., train car 26) may be used to pick up the power from track 12. The arrangement described above is for exemplary purposes only and is not meant to be limiting in nature.

With continued reference to FIG. 1, power source 14 may comprise a conventional AC or DC transformer, depending on the requirements of railroad layout 10, and in particular, train 16. Additionally, power source 14 may provide a fixed output, a variable output, or both. In an exemplary embodiment, railroad layout 10 is an 0-gauge layout and power source 14 is an AC transformer which transforms typical AC line voltage (e.g., 120 VAC) to a reduced level (e.g., 0-18 VAC for a conventional 0-gauge variable output model train transformer) and supplies the same to track 12.

With reference to FIGS. 2A-5 generally, an exemplary embodiment of an inventive train car 26 of train 16, such as a passenger car, is illustrated. Train car 26 includes a main body 28, a controller 30, a motor 32, a door mechanism 34, and a gear set 36. Train car body 28 further defines a longitudinal axis 38 extending along the length of body 28. In an exemplary embodiment, main body 28 of train car 26 includes a door 40 configured for movement between an open and a closed position. A motor 32 driving the door mechanism may be controlled by a controller 30.

Figure 2A:
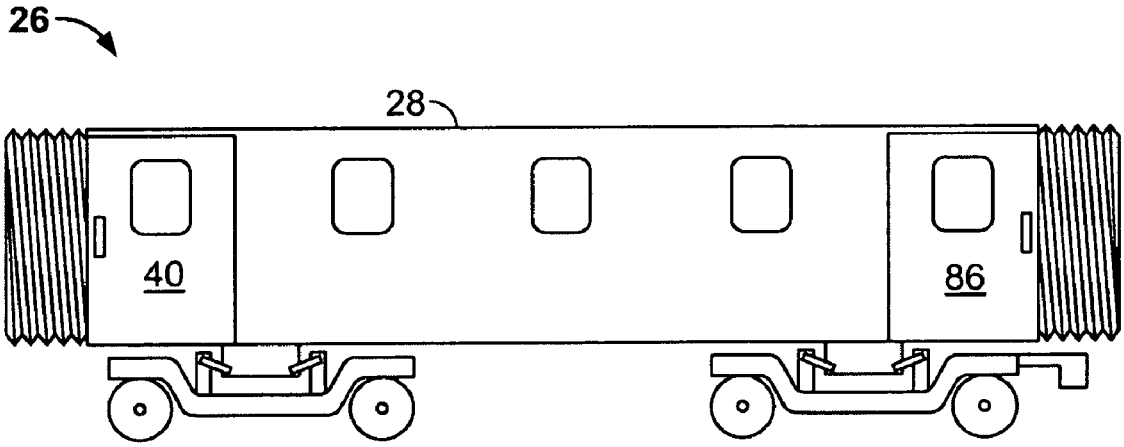
FIGS. 2A and 2B are side elevation views of a model vehicle with motorized doors in accordance with the present invention.
Figure 2B:
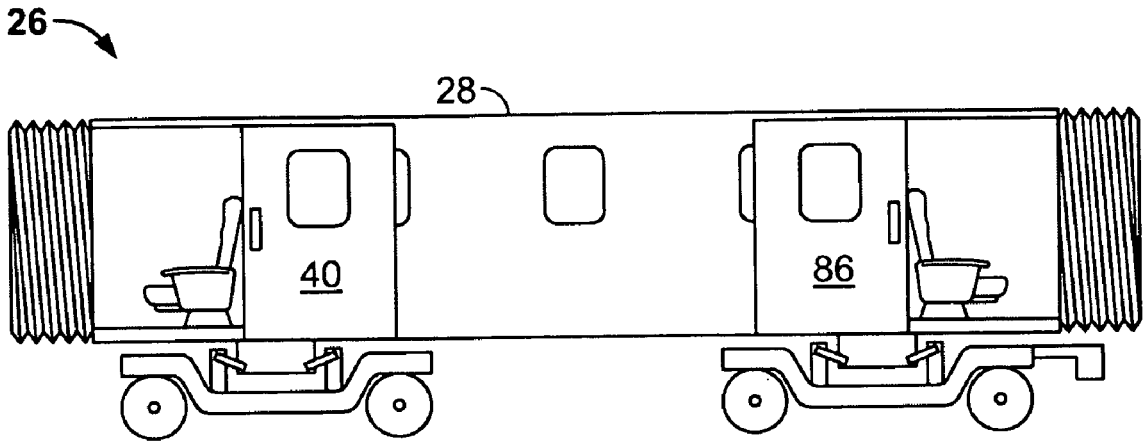

FIG. 2A shows an exemplary train car 26, comprising an exterior body 28 and one or more sliding doors 40, 86. The doors 40, 86 are depicted in a closed position and flush with an exterior panel of body 28. This provides a sleek, realistic look for certain types of model vehicles, for example, a model passenger train car. FIG. 2B shows the same car 26 with doors 40, 86 in an open position. In this embodiment, the doors have been moved outwards of the side exterior panel of body 28, and then slid along the exterior to the depicted open position. Doors 40, 86 may be connected to a driver mechanism in an interior of or underneath car 26 and driven by a motor under automatic control, as described herein.

Figure 3:
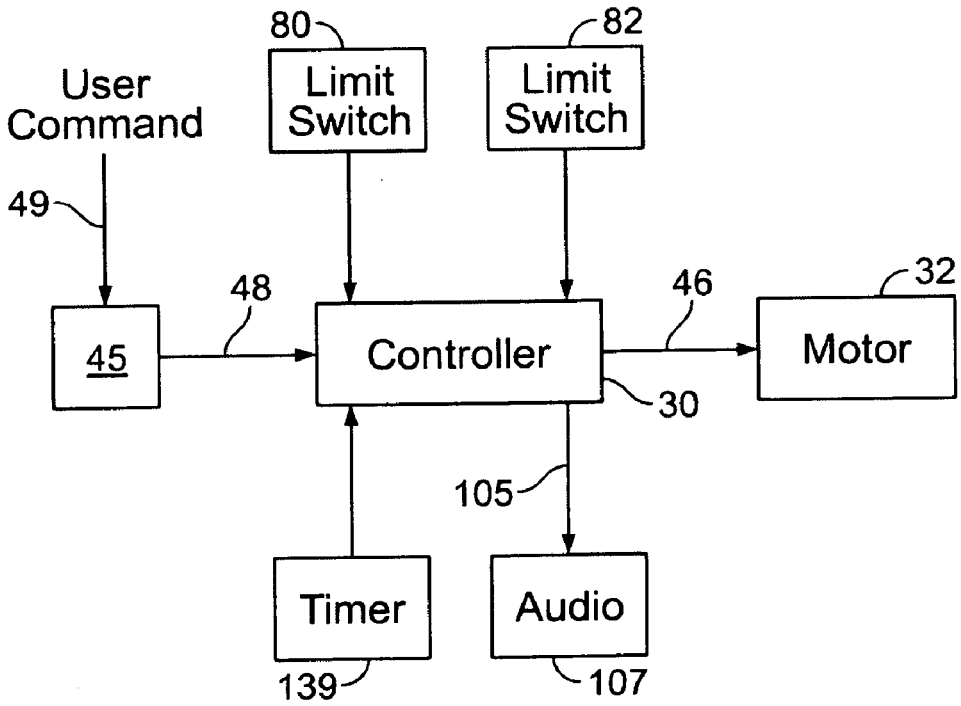
FIG. 3 is a schematic block diagram of a controller for a door mechanism in accordance with the present invention.

FIG. 3 shows an exemplary control system for a door mechanism, comprising a controller 30 operable to receive input signals and to emit output signals. Controller 30 may comprise a microcontroller or any other suitable control device that is configured to carry out the functionality described herein, such as, for example, a microprocessor unit. Controller 30 may be integrated with a control circuit 45 for a model vehicle generally, such as known in the art for control of various train features, for example, horns, bells, whistles, smoke generating units, lights, lights, and sound generators. In the alternative, controller 30 may comprise elements partially or entirely separate from circuitry 45. In an embodiment of the invention, controller 30 may comprise independent elements located on each car equipped with operating doors in accordance with the present invention.

In an exemplary embodiment, controller 30 is configured to generate a control signal 46 in response to a command signal 48. Control signal 46 is may determine the direction of motor rotation, causing an associated door mechanism and door to move between open and closed positions. Controller 30 may receive command signal 48 to open or close the door(s) from control circuitry 45, which, in turn, may receive user commands 49 from the user. In the alternative, or in addition, controller 30 may receive user commands 49 directly from a user interface, such as a keypad on a remote control unit. In embodiments wherein controller 30 is positioned on each train car 26, the command signal 48 from circuitry 45 may be transmitted to controller 30 via a wired or wireless connection, such as an infrared tether between locomotive 24 and train cars 26, or by any other suitable method.

In an exemplary embodiment, controller 30 generates a control signal to activate the motor when it is desired to open door 40, and then discontinues the control signal when it is desired to close door 40. In this embodiment, a spring or other energy storage mechanism may be used to return the door to a normally closed position when the motor is inactive. In the alternative, control signals 46 may comprise a clockwise command and a counterclockwise command for driving the door mechanism, thereby opening and closing the doors. Any other suitable control scheme may also be used.

With reference to FIGS. 1 and 3, in an embodiment of the invention, controller 30 may be configured to receive a command signal 48 corresponding to open and closed positions of door 40. Command signal 48 may be initiated by any suitable method, such as, for example, a user selecting the desired functionality by way of a selection device located on control box 18, or a user sending the desired command 49 by way of a remote control. Likewise, user command 49 may be received by control circuit 45 or controller 30 in a number of ways. For example, control box 18 may be connected to track 12 by way of connectors 50 and 52. Connector 50 connects control box 18 to the center rail of track 12, while connector 52 connects control box 18 to a neutral rail of track 12. Control box 18 receives user command 49 and then transmits the command to control circuit 45 by way of track 12, which then generates and transmits command signal 48 to controller 30. One method of transmitting user command 49 is to use a so-called conventional protocol, which includes superimposing DC offsets on the AC voltage signal supplied to track 12 by power source 14. In this mode, when control circuit 45 detects a DC offset, it generates and sends command signal 48 to controller 30, which in turn generates control signal 46 to activate or deactivate the corresponding feature (i.e., to open or close door 40). This conventional protocol comprises sending positive and negative DC offsets to control circuit 45. The different polarities and amplitudes of the DC offsets correspond to different features of train 12, and accordingly, are each operative to activate at least one of the features. In this approach, control block 18 includes a selection device, such as a pushbutton, that a user can use to select the desired feature and functionality.

A second approach is to use a so-called command control. The techniques of this protocol have been applied to model trains. For example, U.S. Pat. Nos. 5,251,856, 5,441,223 and 5,749,547 to Young et al. disclose, among other things, providing a digital message, which may include a command, to train 16 using various techniques. The digital message(s) so produced may be read by control circuit 45, which may then generate and deliver command signal 48 to controller 30 in response to user command 49. This protocol allows a user to activate and deactivate features, such as for example, opening and closing door 40, with control box 18 or by remote control. In this approach, a user may command door 40 to be opened using a remote control, which sends a user command 49 to control box 18, which then sends the digital message along track 12, which is then picked up by control circuit 45. A user may also select the desired action by way of a selection device on control box 18, which then transmits the digital user command 49 along track 12 to control circuit 45 and then to controller 30 by way of command signal 48. It is foreseeable that a user may also send user command 49 by way of remote control to controller 30 itself, thereby bypassing either control box 18 and/or control circuit 45 altogether. Any other suitable method by which a command can be generated, transmitted, and received may also be used to communicate with controller 30.

With reference to FIG. 3, controller 30 may be further configured to generate a sound control signal 105 so that sounds corresponding to the operation of the doors are played as the doors open and close. To carry out this functionality, controller 30, in an exemplary embodiment, receives input command 49 from control circuitry 45 in the form of command signal 48. In response to command signal 48, sound control signal 105, which may be of three different forms, may be generated by controller 30. Sound control signal 105 may comprise a signal indicating door 40 is being commanded to open, a signal indicating door 40 is being commanded to close, or a signal indicating that movement of door 40 has ceased. Sound control signal 105 may be received by an audio circuit 107, which may be part of control circuitry 45 or separate. The audio circuit may then cause sounds stored in a memory of the audio circuit 107 and corresponding to each of the opening and closing of the door(s), to be played or stopped, depending on the form of sound control signal 105 received.

Further aspects of the control system may include limit switches 80, 82, which provide the controller with a signal when the door mechanism has reached a travel limit. Controller 30 may then operate to stop motor operation. The circuit may also include a timer 139, which may be used to reverse or stop motor operation after a specified period. For example, a door may be made to close one minute after being opened, if a door close command is not received earlier.

Figure 4:
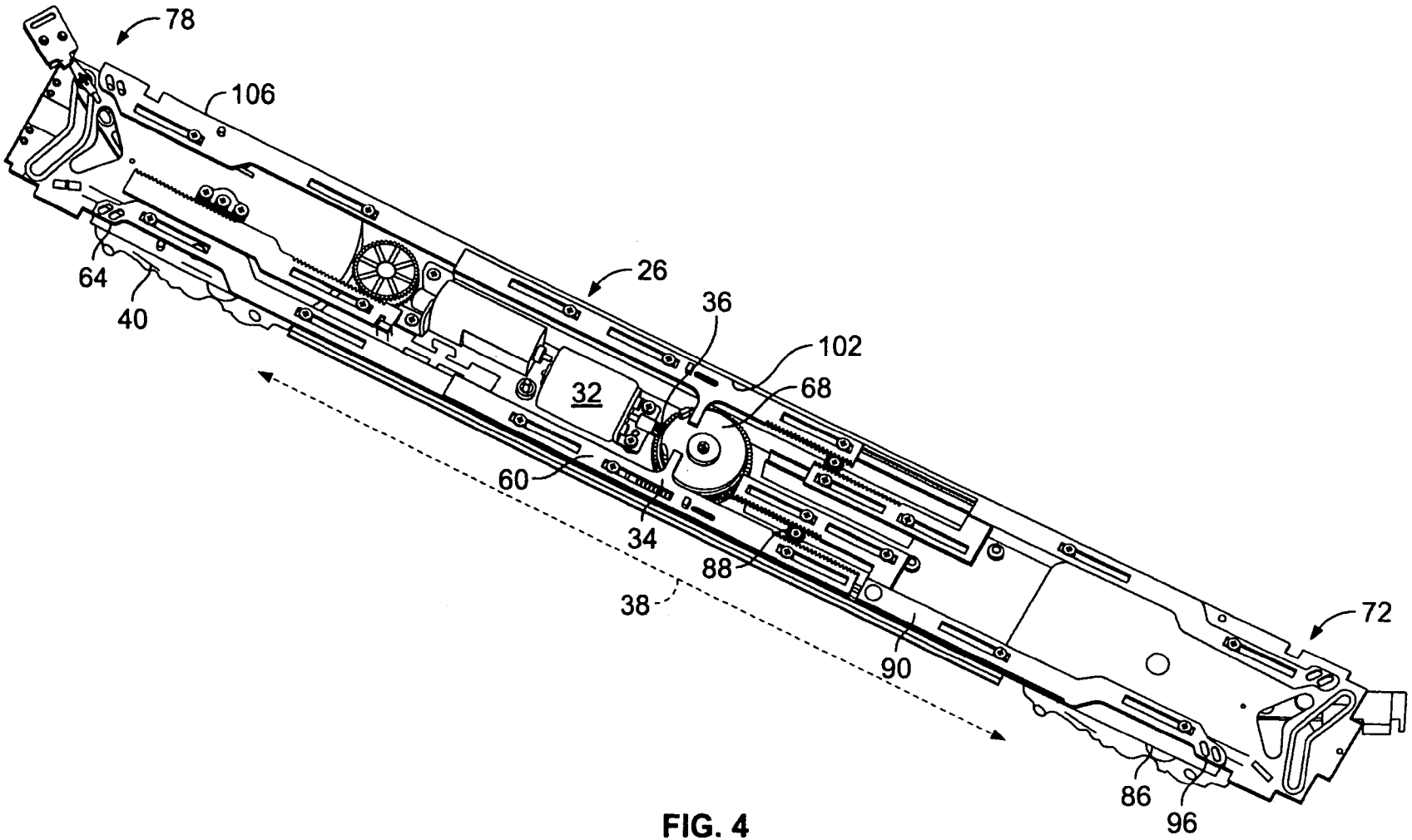
FIG. 4 is a plan view of a portion of a motorized door mechanism in accordance with the present invention, such as may be disposed under a model train car.
Figure 5:
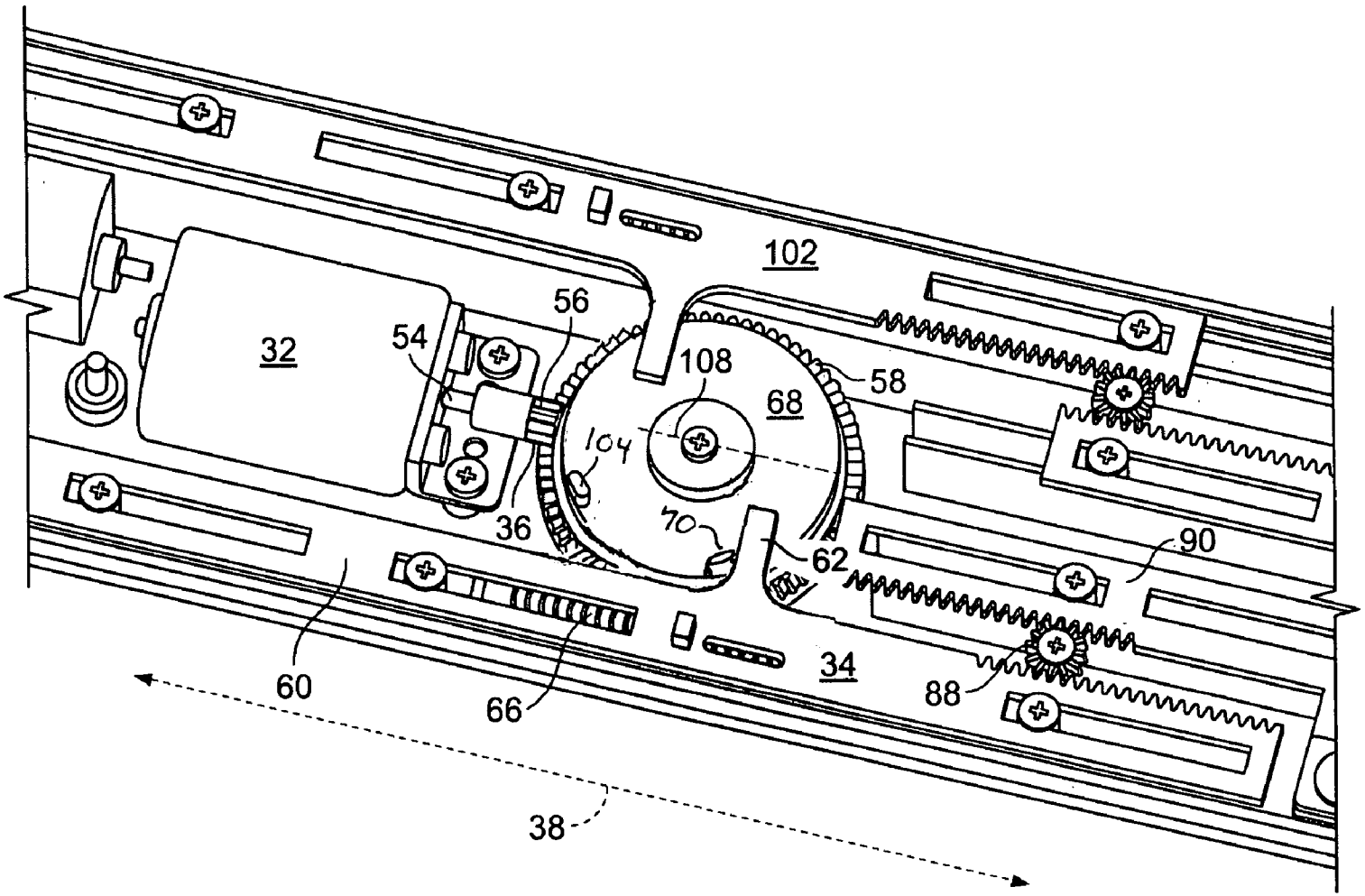
FIG. 5 is an enlarged plan view showing a portion of the underlying door mechanism shown in FIG. 4.

With reference to FIGS. 4-5, an exemplary door mechanism 34 for opening and closing train car doors is depicted. Materials and construction for the depicted mechanism may be as known in the art. Mechanism 34 may be driven by any suitable motor 32, and may be disposed on or adjacent to a frame of a train car, for example, on a lower frame underneath the doors to be operated thereby. Motor 32, which in an exemplary embodiment is a DC motor, is responsive to control signals from a suitable control system to cause rotation of an output shaft 54. As output shaft 54 rotates, its rotation is transferred to door mechanism 34 by way of gear set 36, which is interposed between output shaft 54 and door mechanism 34. In an exemplary embodiment, gear set 36 comprises a first gear, such as a spur gear 56, for example, and a second gear, such as a disk gear 58, for example. Spur gear 56 may be driven by output shaft 54, while disk gear 58 is in mesh with and driven by spur gear 56, and is further configured to drive door mechanism 34. The gear set 36 may be configured to reduce the output speed and increase output torque, depending on the design outputs of the selected motor and the desired input for the door mechanism. Various other gear arrangements and gear sets may also be suitable for carrying out a desired mechanical transformation of motor output.

With reference to FIG. 5, rotary motion of the disk gear 58 may be transformed into linear motion by interaction of pins 70, 104 with corresponding surfaces of sliding linear actuators 60, 102. An adaptor disk 68 may engaged with disk gear 58. Disk 68 may comprise a pin or cam 70 positioned on a face of disk 68 at an outward radial position. In operation, when a user desires to open a door of a train car, the motor 32 may be operated, for example, so as to rotate gear 58 and disk 68 counter-clockwise. When gear 68 is rotated counter-clockwise, pin 70 is urged against tab 62, causing actuator 60 to slide to the right, to the positions shown in FIGS. 4 and 5. As actuator 60 slides to the right, spring 66 may be compressed between actuator 60 and a frame member for the train car. Spring 66 thereby stores energy for restoring the actuator to its rest position when gear 58 rotates clockwise. Likewise, continued clockwise rotation of gear 68 from the resting position shown will urge pin 104 against actuator 102, causing it to slide to the right.

With reference to FIGS. 4-5, when actuator 60 is moved towards the right, pinion gear 88 is rotated counter-clockwise by an engaged rack that is part of actuator 60. Meanwhile, counter-clockwise rotation of pinion 88 drives actuator 90 to the left. Actuator 60 may thus be used to drive a car door on one end of a car rightward towards the center of the car, while actuator 90 drives a door at an opposite end of the car leftward towards a center of the car, opening both doors synchronously. Actuators 102, 103 on the opposite side of the car may similarly be operated when gear 58 is rotated clockwise sufficiently to engage pin or cam 104 with actuator 102. It should be apparent that the depicted mechanism is operable to operate doors on both sides of the train, but not at the same time. Because actual train doors are normally operated only on one side of the train, that is, on the side facing a train platform, this feature should not detract from enjoyment of the model vehicle. However, one of ordinary skill may devise other suitable mechanisms for opening doors on one or both sides of a model vehicle at the same time.

Actuators 60, 90, 102, 103 may drive corresponding train doors via guide slots 64, 96 that guide the doors outward and inward with respect to the train, while also transmitting the lateral motion of the actuators, as shown in FIG. 4. Operation of the guide slots is shown schematically in FIG. 6. A door (e.g., door 40 in FIGS. 2A-B) may comprise or be attached to a guide member 42. Guide member 42 may be configured to travel within or along a groove in the floor of a train car body, thereby guiding door 40 when it is moved between open and closed positions. Guide member 42 may comprise one or more pins 44 that are disposed within the track in the floor or other part of a train car to guide door 40. A passive guide rail or slot (not shown) may be used at an upper end of the door to keep the door aligned with the car body. Various other guide mechanisms may also be suitable, and any suitable mechanism may be used.

Figure 6:
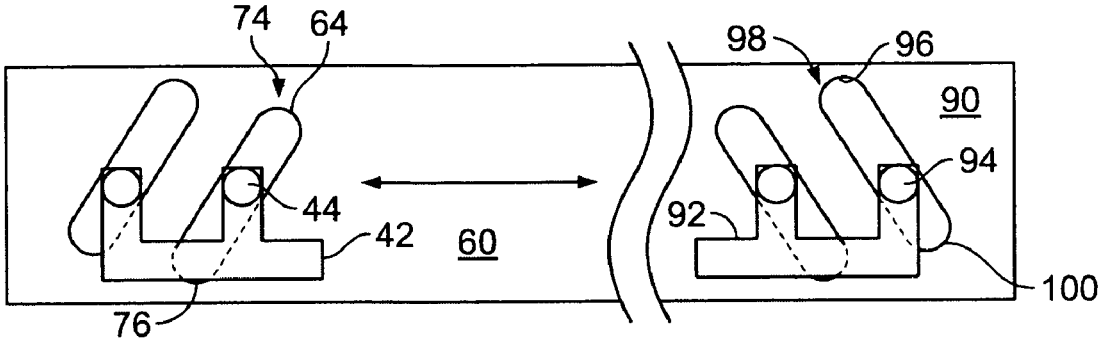
FIG. 6 is a partial plan view of a rack assembly for a door mechanism in accordance with the present invention.
Figure 7A:
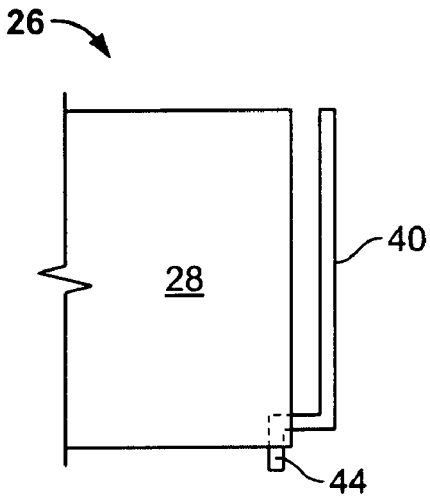
FIGS. 7A and 7B are partial front elevation views of a model vehicle with operating doors in accordance with the present invention.
Figure 7B:
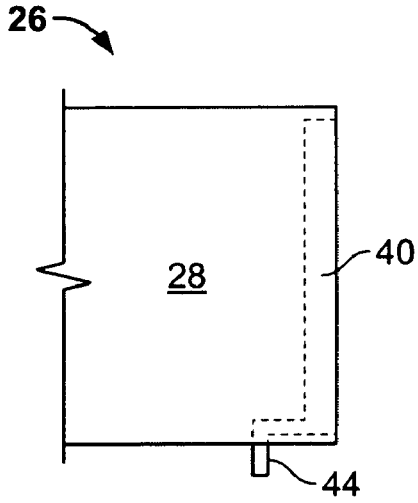

Door mechanism 34 may thereby be coupled to door 40 and configured to move door 40 between open and closed positions in response to a control signal. FIG. 7A shows an end view of a door 40 in a open position, held outward of car 26 body 28. FIG. 7B shows door 40 in a closed position, flush with body 28. Referring to FIGS. 6-7B, guide slots 64, 96 of actuators 60, 90 interact with guide members 42, 92, such that when the doors are in an open position, they are offset outwardly from and overlap a panel of train body 28. Likewise, when door 40 is in a closed position, the guide slots pull the door flush with train car body 28. More particularly with respect to actuator 60, one or more angled slots 64 contain pin(s) 44 of guide member 42, connected to door 40. Pin 44 of guide member 42 may extend through the groove in the floor of train car body 28 and into slot 64.

Referring again to FIGS. 4-7B, as actuator 60 moves along the length of train car body 28 in a first axial direction 72 relative to longitudinal axis 38, pin 44 of guide member 42 may be forced to ride along angled slot 64, within which it is disposed. Pin 44 rides from a first end 74 of slot 64 to a second end 76 of slot 64, causing door 40 to first be pulled in a transverse direction relative to axis 38, out and away from train car body 28. When pin 44 reaches second end 76 of slot 64, it is effectively captured by slot 64 such that the continued movement of rack 60 causes guide member 42 and door 40 to be pulled in an axial direction relative to axis 38, thereby causing door 40 to slide along the length of body 28 to its open position. Actuator 90 operates in a similar manner to open and close the door at the opposite end of the car (e.g., door 86 shown in FIGS. 2A-B).

In an embodiment of the invention, when a user sends a command to close the train doors, a control signal activating motor 32 may be discontinued. In the alternative, a "close" command may cause a reversal of rotation of the output shaft (i.e., from counterclockwise to clockwise, or vice versa). This causes contact between cam 70 and tab 62 to be broken. Spring 66 then urges actuator 60 to move in a reverse axial direction. As motion of actuator 60 reverses, pin 44 rides within angled slot 42 from second end 76 of slot 64 to first end 74 of slot 64. As pin 44 travels, guide member 42 and door 40 are pushed both transversely and axially relative to axis 38 along the length of train car body 28, in and towards body 28 to a closed position wherein door 40 is flush with body 28. The speed with which the doors open and close may thereby be determined by the motor speed and the motor's associated gear set.

In an embodiment of the invention, train car 26 may further include a pair of limit switches (not shown) electrically connected to controller 30. One member of the pair of may be disposed to indicate door 40 reaching a fully open position. The other member of the pair may be disposed to indicate door 40 reaching a fully closed position. Limit switches or other sensors may be configured to be activated by door mechanism 34, such that when door mechanism 34 reaches a predetermined point of travel in either direction 72, 78, a limit signal is generated. In response to the limit signal, controller 30 may discontinue the rotation of output shaft 54 or change the direction of rotation. In the alternative, or in addition, train car 26 may also include a clutch mechanism, which may decoupled door mechanism 34 from output shaft 54 in response to a user command or sensor input.

A train car according to the invention may comprise more than one door on more than one side of train car body 28. For instance, with reference to FIGS. 2A-2B and 4, train car body 28 may include a pair of doors 40, 86 on the same side of the train car body 28 that may be opened synchronously, or in another embodiment, individually. The second door 86 may be operated by a second actuator 90, which is connected to actuator 60 via a reversing mechanism around pinion gear 88. In the alternative, or in addition, the second door may be driven by an actuator in the same direction as actuator 60. The operation of the second actuator may be substantially the same as for actuator 60 and door 40. The second actuator 90 may comprise guide slots 96 cooperating with guide pins 94 and guide member 92 attached to door 86. In the depicted embodiment, the operation of the second actuator should be apparent from inspection of FIGS. 4-6 and the specification herein, and need not be described in detail. Likewise, doors with actuators 102, 103 may be provided on an opposite side of the train, the operation of which should also be apparent.

Figure 8:
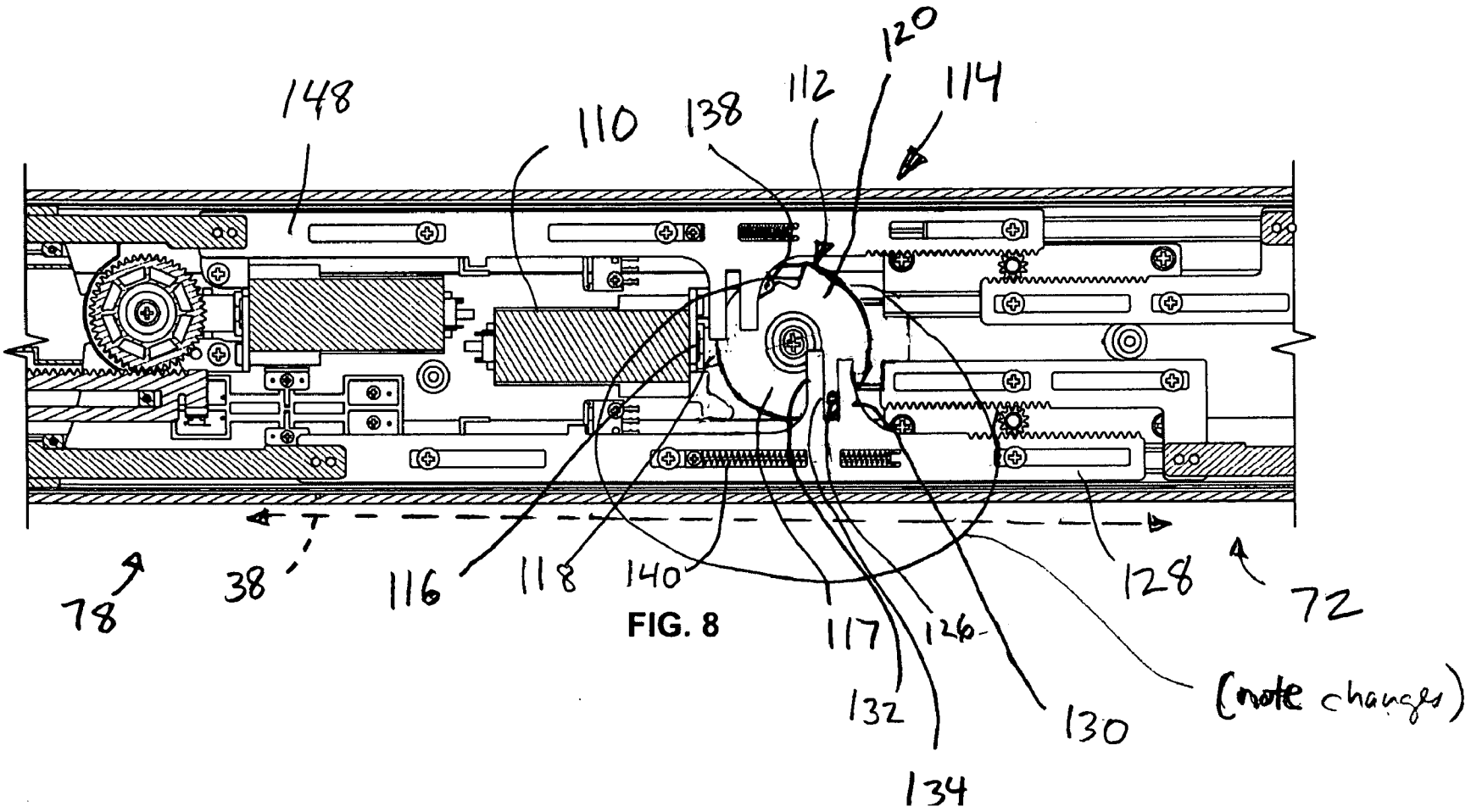
FIG. 8 is a partial plan view of a portion of a door mechanism, according to an alternative embodiment of the present invention.
Figure 9:
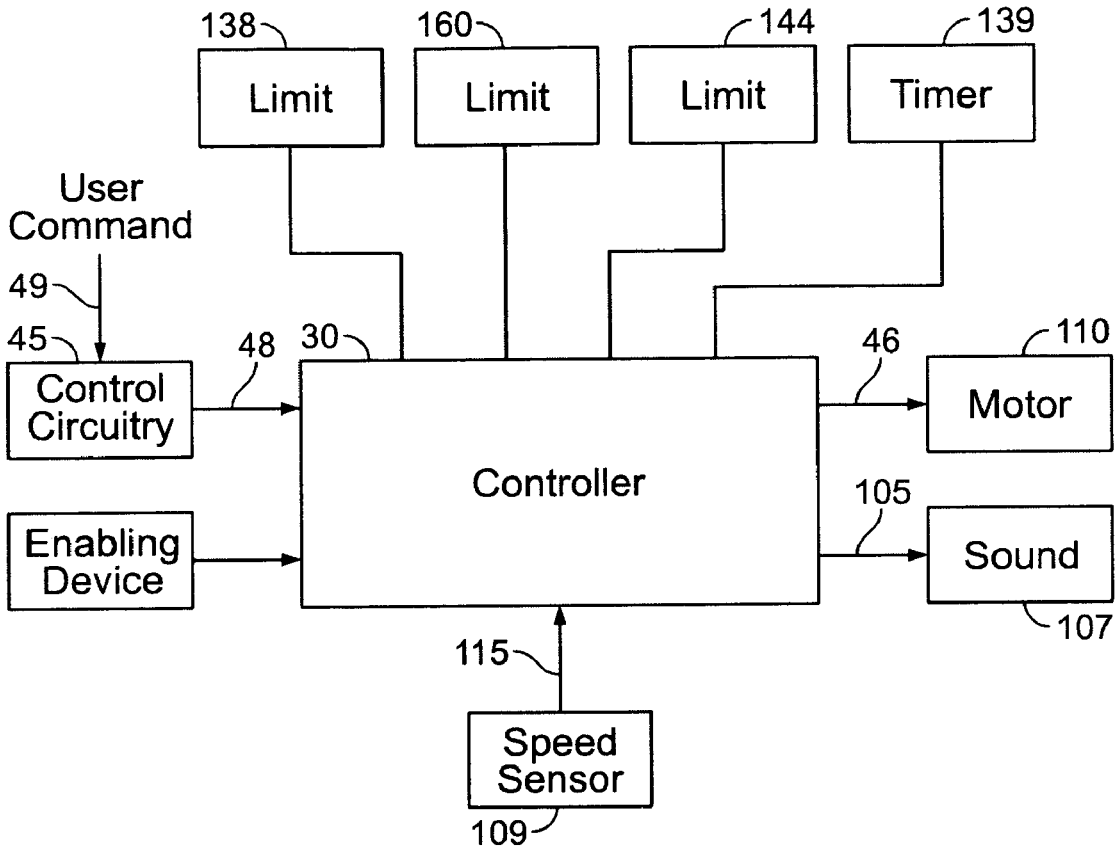
FIG. 9 is a schematic block diagram showing an alternative embodiment of a controller in accordance with the present invention.

FIGS. 8-10 show elements of a door mechanism 114 according to an alternative embodiment of the present invention. In this embodiment, the same general functionality and structure with regard to main body 28, controller 30 and door 40 set forth above may apply. In addition to main body 28, controller 30, and door 40, train car 26 includes a speed sensor 109, a motor 110, a gear set 112, and a door mechanism 114.

With reference to FIG. 8, in this embodiment, motor 110 may comprise a geared DC motor, as opposed to a direct drive motor. Motor 110 may comprise a gear reduction block 116 and an output shaft 118. Gear set 112 may comprise a gear associated with output shaft 118, such as, for example, a spur gear or pinion gear, and a drive gear 117, such as, for example, a disk gear. In the illustrated arrangement, output shaft 118 is coupled to drive gear 117 such that clockwise or counterclockwise rotation of output shaft 118 causes corresponding rotation of drive gear 117. Drive gear 117, in the illustrated embodiment, may be generally circular or disk-like in shape having a plurality of teeth 119 disposed along a predetermined portion of the radial edge of a first side 120 thereof (best shown in FIGS. 10A-10B). Teeth 119 of drive gear 117 may be configured so as to mesh with the gear coupled to output shaft 118 when fully assembled. A second side 122 of drive gear 117 may comprise a recess or aperture 124 into which an actuating pin 126 is inserted. Accordingly, when motor 110 is activated, output shaft 118 rotates, which then causes drive gear 117 to rotate. As drive gear 117 rotates, pin 126 moves with drive gear 117.

With continued reference to FIG. 8, door mechanism 114 comprises a linear actuator 128. Actuator 128 may be configured to move in first and second axial directions 72, 78 relative to longitudinal axis 38, and to transform the rotation of drive gear 117 to linear motion of a door of the train car along two intersecting axes. To this end, actuator 128 may comprise a pair of protrusions 130, 132 that are spaced a predetermined distance apart so as to define a slot 134 therebetween. As drive gear 117 rotates, pin 128 makes contact with protrusion 130. As drive gear 117 continues to rotate, pin 128 is captured within slot 134 and maintains contact with protrusion 130, thereby causing actuator 128 to move along the length of train car body 28 in an axial direction 72 relative to axis 38. FIG. 8 shows actuator 128 moved rightward to a "door open" position.

As with actuator 60, actuator 128 further includes one or more angled slots (not shown) within which pin(s) 44 of guide member 42 of door 40 are disposed. Accordingly, the same functionality and description above with respect to the arrangement and interaction of actuator 60, door 40 in opening door 40 also applies to the arrangement of door 40 and actuator 128. Therefore, as actuator 128 continues to move, door 40 is opened.

When actuator 128 reaches a predetermined position that corresponds to door 40 being in a fully open position, a tab 136 protruding from actuator 128 makes contact with and actuates a limit switch 138 corresponding to the open position, as shown in FIG. 8. Once actuated, limit switch 138 may cause a signal to be sent to controller 30 to cease rotation of output shaft 118. In the event that limit switch 138 fails, controller 30 may further include an electronic timer 139, which may be internal or external to controller 30, that is configured to cut-off control signal 46, and therefore, stop motor 110 after a predetermined time elapses.

As discussed above, drive gear 117 includes a plurality of teeth 119 disposed along a predetermined portion of the radial edge thereof. Teeth are not provided along the complete circumference so that if limit switch 138 fails and motor 110 continues running, the mechanism will not "over-run" and jam. Accordingly, in operation, if limit switch 138 is not actuated and motor 110 continues running, the portion of drive gear 117 that does not have teeth will eventually be reached, thereby causing the teeth of drive gear 117 and the teeth 119 of the gear associated with output shaft 118 to become out of mesh and stopping the rotation of drive gear 117. After a predetermined amount of time, the electronic timer 139 will cut-off control signal 46, and motor 110 will turn off.

Train car 26 may further comprise at least one tension spring 140 coupled between train car body 28 and actuator 128 that is operative to maintain door 40 in a closed position unless commanded to open. Accordingly, when motor 110 is shut off, spring 140 causes actuator 128 to slide back slightly so that the teeth 119 of drive wheel 128 and the teeth of the gear of output shaft 118 become meshed again. In an exemplary embodiment, an indicator light (not shown) may also be provided to notify the user that there has been a failure in the door operation.

When door 40 is in a fully open position and it is desired to close the door(s), drive gear 117 may be rotated in a reverse direction, for example, clockwise. As drive gear 117 reversed, pin 126, which is in slot 134, makes contact with protrusion 132. As drive gear 117 continues to rotate, the arrangement of pin 126 and protrusion 132 causes actuator 128 to move in second axial direction 78 relative to axis 38. As actuator 128 continues to move, door 40, by way of the guide 42 and pin 44 arrangement, is pushed both transversely and axially relative to axis 38 along the length of train car body 28 and in and towards body 28 to the closed position wherein door 40 is flush with body 28. As drive gear 117 reaches a position in its rotation that corresponds to door 40 being in a closed position, a notch 142 in drive gear 117 may make contact with and actuate a second limit switch 144, indicating that door 40 is closed and causing motor 110 to stop.

As discussed above, tension spring 140 may be provided to keep door 40 in a closed position as train 16 operates or until the doors are commanded open. Accordingly, spring 140 extends as door 40 opens, compresses as door 40 closes, and remains compressed until door 40 is opened again.

Operation of additional doors on the same or opposite sides of the train car may be accomplished in a similar fashion as the first exemplary embodiment. The structure and operation details for such additional doors should be apparent from inspection of FIG. 8, without further description. For example, a second actuator 148 may operate in a complementary mirror-image fashion to actuator 128, but on an opposite side of the train car. Likewise, for operating an additional door on the same side of the train, additional actuators and reversing mechanisms are shown at the right of FIG. 8, similar to those already shown and described with respect to FIGS. 4-5.

In an embodiment of the invention, a control system incorporating a model vehicle speed sensor 109 may be provided for control of a motorized door mechanism, as shown in FIG. 9. Speed sensor 109 may be provided to detect the speed of train 16 and to generate a speed signal 115 corresponding to the sensed speed. Speed sensor 109 may comprise any suitable speed sensor as known in the art, and may be electrically connected to controller 30 such that controller 30 receives and processes speed signal 115. The speed signal may be used to prevent operation of the motorized door mechanism when the motor vehicle is moving. So long as the vehicle is in motion, controller 30 may maintain motor 110 in an inactive or closed stated.

Other inputs to controller 30 may include limit signals from limit switches 138 and 144, or other suitable limit sensors, which may be disposed as described in connection with FIG. 8. Controller 30 may be configured to interpret signals from the limit switches to stop motor operation and maintain the doors in an open or closed state. Another input may include a timer 139, as previously described, which may be used to prevent excessive idling of the motor in the case of a failure of a limit sensor.

Other aspects of the control circuit may be as previously described in connection with FIG. 3. Controller 30 may receive user commands 49 via a control circuit 45 for the model vehicle. In the alternative, the controller 30 may communicate directly with a user interface device to receive user commands. The control circuit may also be equipped to have the sound generating circuit 107 supplied with sound control signals 105, as discussed above.

The control system may further comprise an enabling device 150, that is configured to allow a user to temporarily disable automatic operation of the motorized door. As shown in FIG. 9, the enabling selection device may be electrically connected to an input of controller 30, such that controller 30 is operative to disable the door function. The mechanical selection device may take the form of any number of existing selection devices, such as, for example, a pushbutton, toggle switch or the like, and may be located or positioned on a user control device such as a remote control, a trackside control box 18, or on a train car itself.

Figure 10A:
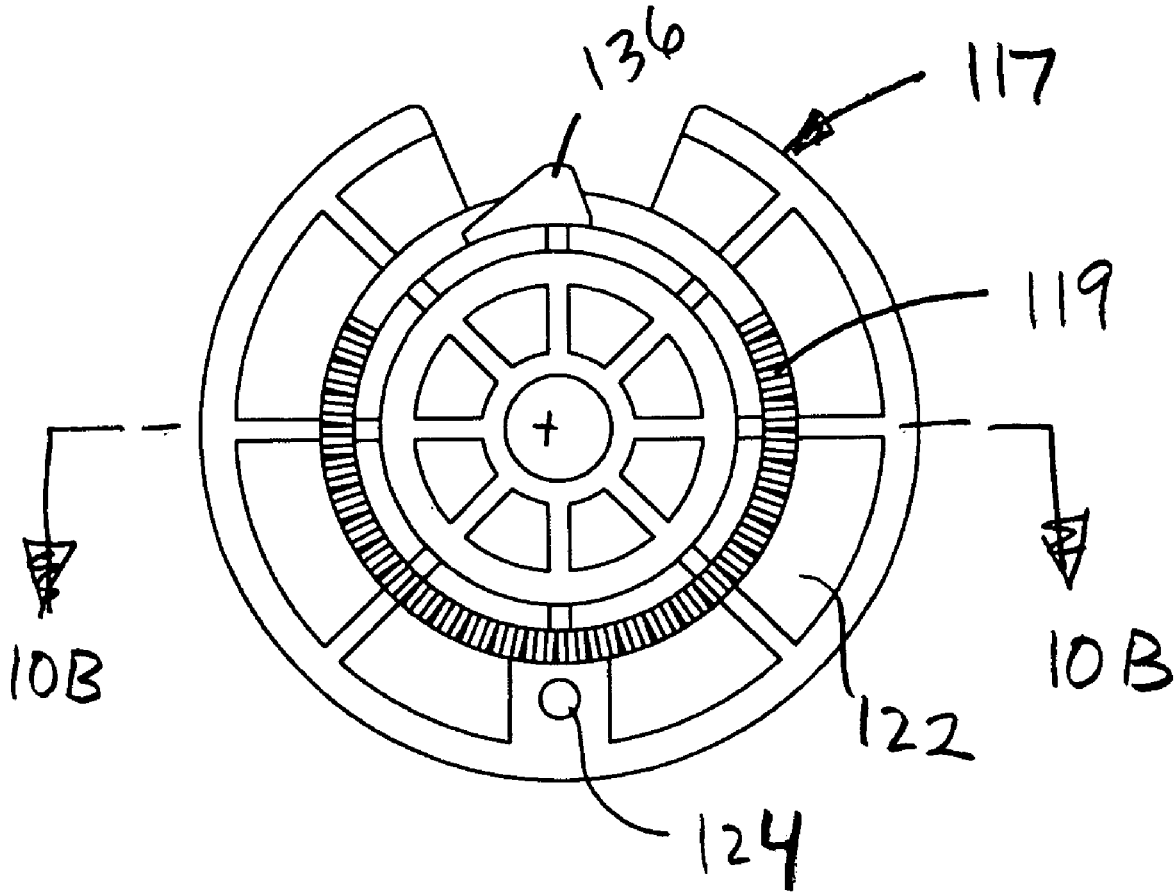
FIGS. 10A and 10B are plan and cross-sectional views, respectively, showing an exemplary drive wheel of a door mechanism according to the present invention.
Figure 10B:
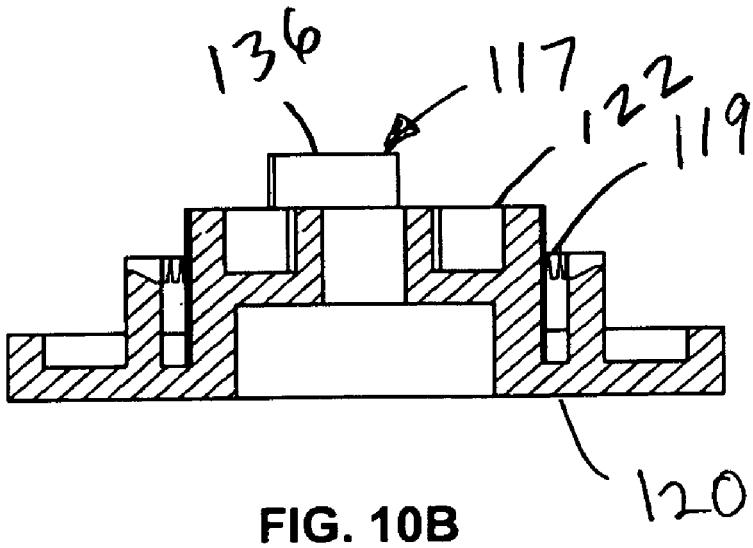

FIGS. 10A and 10B show details of drive gear 117, as already described in connection with FIG. 8. Gear 117 may comprise a generally circular or disk-like shape having a plurality of teeth 119 disposed along a portion of the radial edge of first side 120. A portion of the gear circumference lacks teeth, to prevent the mechanism from being overdriven in case of failure of a limit switch. Various other gear shapes may also be suitable.

Having thus described a preferred embodiment of a model vehicle with an automated door mechanism, it should be apparent to those skilled in the art that certain advantages of the within system have been achieved. It should also be appreciated that various modifications, adaptations, and alternative embodiments thereof may be made within the scope and spirit of the present invention. For example, a particular door mechanism has been illustrated, but it should be apparent that the inventive concepts described above would be equally applicable to other mechanisms arranged according to the spirit and scope of the invention. The invention is defined by the following claims.

What is claimed is:

1. A model vehicle, comprising:

a reduced-scale model vehicle;

a reduced-scale model door mounted to the model vehicle and configured to move between a open position and a closed position, wherein the door is displaced outward of and substantially parallel to an adjacent exterior wall panel of the model vehicle thereby exposing a door opening when in the open position, and the door is substantially flush with and substantially parallel to the adjacent exterior wall panel thereby covering the door opening when in the closed position;

a motorized drive unit mounted to the model vehicle and operably associated with the model door so as to open and close the model door between the open position and the closed position;

a control circuit operably connected coupled to the motorized drive unit, the control circuit being adapted to receive remotely transmitted command signals to selectively cause the model door to open and close between the open position and closed position; and wherein the motorized drive unit comprises a motor having an output shaft providing rotational input to a gear set that is operably associated with a mechanism for transforming rotational movement into linear movement, and wherein the mechanism for transforming rotational movement into linear movement comprises a rotating cam urged against a sliding linear actuator.

* * * * *